United States Patent [19]

Ibarrola

[11] Patent Number: 4,893,706

[45] Date of Patent: Jan. 16, 1990

[54] MECHANISM FOR THE RECEPTION AND COLLECTION OF COINS IN COIN-OPERATED MACHINES

[75] Inventor: Jesûs E. Ibarrola, Navarra, Spain

[73] Assignee: Azkoyen Industrial, S.A., Peralta, Spain

[21] Appl. No.: 163,249

[22] Filed: Mar. 2, 1988

[30] Foreign Application Priority Data

Mar. 3, 1987 [ES] Spain ..... 8700583

[51] Int. Cl.[4] ..... G07F 1/04; G07F 9/04

[52] U.S. Cl. ..... 194/346; 194/229; 453/29

[58] Field of Search ..... 194/229, 231, 343, 344, 194/346, 350, 351, 352; 453/29, 37, 39, 40, 41, 43, 49

[56] References Cited

U.S. PATENT DOCUMENTS

| | | | |
|---|---|---|---|
| 1,625,979 | 4/1927 | Brinkerhoff | 194/351 X |
| 3,415,256 | 12/1968 | Meloni | 453/41 |

FOREIGN PATENT DOCUMENTS

| | | | |
|---|---|---|---|
| 3512579 | 10/1986 | Fed. Rep. of Germany | 194/346 |
| 2293749 | 7/1976 | France | 194/343 |
| 549841 | 12/1985 | Spain . | |
| 0011006 | of 1892 | United Kingdom | 194/344 |
| 727581 | 4/1955 | United Kingdom . | |
| 2022887 | 12/1979 | United Kingdom . | |
| 2022897 | 12/1979 | United Kingdom | 194/346 |
| 2047936 | 12/1980 | United Kingdom . | |
| 2070307 | 9/1981 | United Kingdom | 194/346 |
| 2135094 | 9/1984 | United Kingdom . | |

*Primary Examiner*—Joseph J. Rolla
*Assistant Examiner*—Edward S. Ammeen
*Attorney, Agent, or Firm*—Bernard, Rothwell & Brown

[57] ABSTRACT

A mechanism for the reception and collection of coins in coin-operated machines includes a frame that can be moved along guides, located immediately beneath the coin selector or entry, which frame is divided into a series of identical vertical chambers, open at the top and bottom and on one of their transverse walls, with apertured plates for opening and closing the bottom and the side wall. The mechanism can be moved along the guides so that the open tops of the chambers are successively positioned under the exit of the selector. The mechanism for driving the frame, as well as the mechanism that drives gates that open and close the chambers, are controllable by a microprocessor, based on the information provided concerning the chamber in which each coin is located and the position of the frame at any given moment, which is provided by a decoder that is part of the frame and a reader that is stationary with respect to the frame.

10 Claims, 5 Drawing Sheets

MECHANISM FOR THE RECEPTION AND COLLECTION OF COINS IN COIN-OPERATED MACHINES

FIELD OF THE INVENTION

This invention relates to a mechanism for the reception and collection of coins in coin-operated machines, permitting the reception of a number of coins of the same or different values, the collection of the coins corresponding to the exact or closest value of the product or service selected by the user, and the return of the remaining coins, without the need for operating a return control The mechanism of the invention is intended for installation below the coin selector of the machine, for the purpose of collecting the coins accepted by said selector.

Coin-operated machines are equipped with a selector mechanism that accepts or rejects the coins, depending on whether or not they are genuine, the accepted coins falling into a receiving chamber, which also serves as a payment device in the case of game machines and as a return device in the case of vending machines. With this arrangement, all of the coins inserted into and accepted by the machine, even though they may be greater in number than what is required to obtain a given product or service, fall into the receiving chamber, it being necessary that the return mechanism operate to return the excess coins inserted and the change for the correct amount of coins.

The object of this invention is to develop a mechanism that is placed between the coin selector and the receiving chamber and the purpose of which is to receive all the coins inserted at a given time, to obtain a product or service. This mechanism retains all of the coins until the user selects the desired product or service. At this point, the mechanism of the invention allows only those coins corresponding to the exact or closest value of said product or service to fall into the receiving chamber, whereas any excess coins inserted are returned directly, without going through the receiving chamber and without the need for operating any return device.

SUMMARY OF THE INVENTION

The mechanism of the invention consists of a frame that can be moved along guides or rails, located immediately under the coin selector of the machine. This frame includes a series of identical, vertical and consecutive chambers, which are open at the top and bottom as well as on one of their lateral walls, whereas the opposite transverse wall is closed by means of a stationary wall. A means of opening and closing are provided at the open bottom and the open lateral wall of the chambers.

To drive the frame there is a mechanism that moves said frame in a direction perpendicular to said chambers, successively positioning the open top of said chambers opposite the exit of the selector, so that each of said chambers receives a coin. There are also mechanisms for driving the means of opening and closing the open bottom and the open lateral wall of the chambers.

The length and the height of each chamber are greater than the diameter of the largest acceptable coin, and the width is slightly larger than the thickness of said coin. The bottom of each chamber is formed by the abovementioned means of closing, consisting of a surface that is slanted longitudinally in a downward direction toward the open lateral wall.

Both the mechanism for driving the frame and the mechanism for driving the gates can be activated by a microprocessor, based on the information provided concerning the chamber occupied by each coin and the position of the frame at any given moment. This information is provided by a coder included in the frame and a reader that is stationary with respect to said frame.

The series of chambers can be formed by means of identical, parallel and equidistant vertical partitions mounted on the frame so as to form vertical passages that are closed laterally on one side by a stationary wall and on the opposite side, as well as at the bottom, by plates with apertures that can be positioned opposite said passages for the release of the coins contained in said passages, the top being open to receive coins. The lower edge of all the partitions slants downward toward the open, lateral wall. The plate that closes the bottom of the passages or chambers is positioned against this lower edge, taking the same downward slant toward the open lateral wall.

Said plates comprise the abovementioned means of closing the open lateral wall and bottom.

The plate that closes the open lateral wall of the passages or chambers has vertical windows, starting at the lower edge, which are of the same width as said chamber and of a height greater than the diameter of the largest acceptable coin. These apertures are spaced at a distance equal to the width of the walls or partitions separating chambers or passages. Said plate is mounted between horizontal guides, on which it can be moved between two end positions, one being the closed position, in which the windows are opposite the vertical partitions or walls, and the other the open position, in which said windows are opposite the vertical chambers or partitions, permitting the release of the coins, which fall into a return channel. This plate is also impelled toward the closed position by means of a spring. The movement to the open positions occurs when the plate, at the end of the travel of the frame in one direction, hits a stationary lateral stop, nullifying the force of the spring.

The plate that closes the bottom of the chambers or passages is stationary with respect to the frame and has a transverse aperture, the dimensions of which are equal to or slightly larger than those of the open bottom of the chambers. Under said plate is a gate for opening and closing said aperture. As the frame moves, this aperture is positioned under each of the different chambers in succession, making it possible, when the corresponding gate is open, for the coins to fall into the collection channel.

The gate that closes the aperture of the plate that closes the bottom of the chambers can be flat, positioned under said plate, able to slide between a closed position where the aperture is blocked, and an open position, said gate being driven by an electromagnet. The gate can also consist of a cylinder located under the plate in a position tangential or slightly secant to the aperture wherein the cylinder has a groove passing through its diameter of the same dimensions as those of the open bottom of the chambers. This cylinder is mounted so that it can make a partial turn between two positions, one an open position, in which the diametric groove of the cylinder is aligned with the aperture of the plate, and the other a closed position, in which said groove is angularly askew, the lateral surface of the cylinder closing the aperture. The cylinder is driven by an electromagnet.

To drive the frame there is a rack which is a part of said frame, and a pinion, which meshes with said rack and is moved by an electric motor.

Both the electric motor that drives the frame and the electromagnet that drives the gate located in the aperture of the plate that closes the open bottom of the chambers are controlled by the abovementioned microprocessor.

A more detailed description of the mechanism of the invention is given below, the purpose of which is to illustrate more clearly the characteristics and operation thereof, with the assistance of the attached drawings, in which one possible method of execution is represented by way of non-limitative example.

BRIEF DESCRIPTION OF THE DRAWINGS

In the drawings:

As shown in the drawings, the mechanism of the invention consists of a frame formed by two parallel lateral walls, indicated by the numbers 1 and 2, between which there is an intermediate transverse wall 3. Near one of the edges of intermediate transverse wall 3, walls 1 and 2 have openings in which bushings 4, FIG. 3, are fitted for the passage of stationary bars 5 which serve as guides on which the frame is mounted and can be moved. Near the opposite edge of intermediate wall 3, between walls 1 and 2, are vertical partitions 6 that form chambers or passages 7, which are open at the top and the bottom and on the side or lateral wall opposite intermediate wall 3. The open lateral wall of the chambers or passages 7 is closed by means of a plate 8 with horizontal grooves 9 through which pivots 10 of the frame pass, serving as guides for the partial movement of said plate with respect to the frame. As shown in FIG. 1, starting at the lower edge of plate 8 are vertical windows 11 which are of the same width as the passages or compartments 7 and which are separated from one another by bands 12 of approximately the same width as the partitions 6. Plate 8 can be moved along the guides formed by pivots 10 and grooves 9 between two positions, one a closed position, shown in FIG. 1, in which the bands 12 are opposite the chambers 7, closing them laterally, and the other an open position, in which the windows 11 are opposite the compartments or passages 7 which are laterally opened in this manner.

Figure 3:
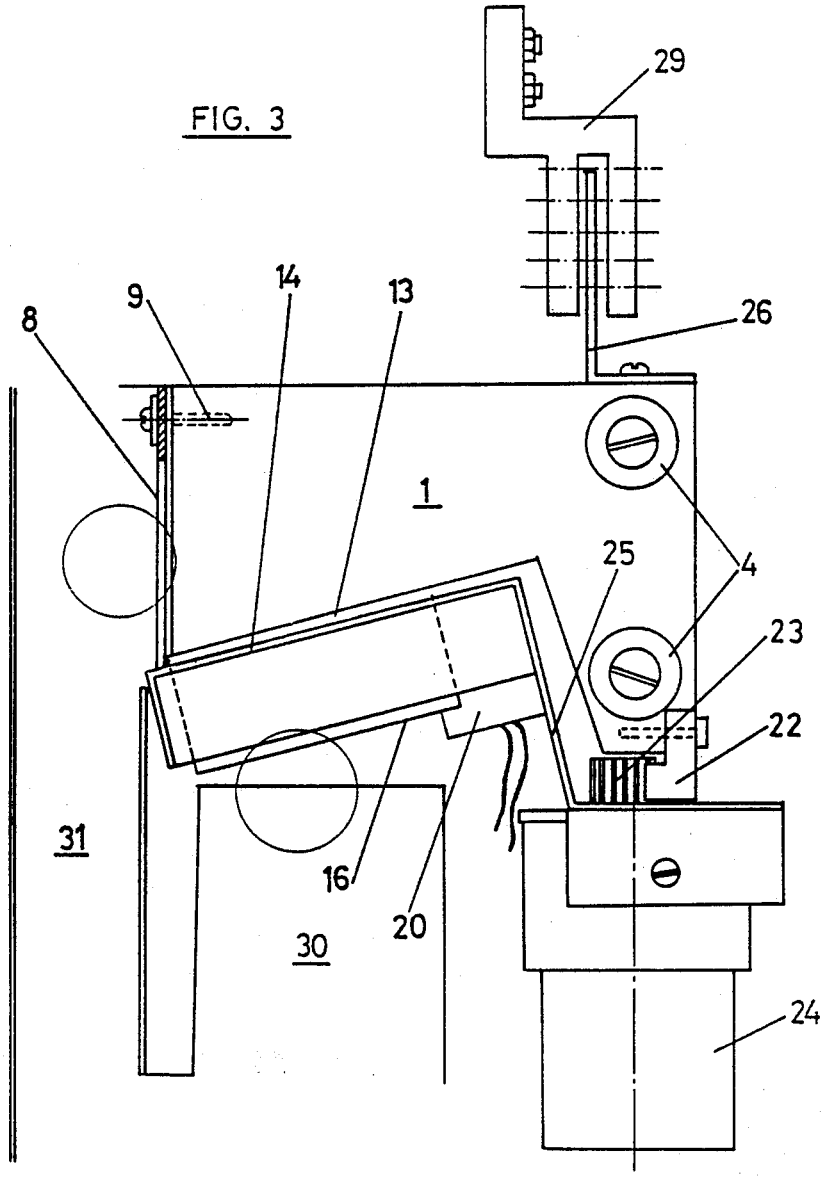
FIG. 3 is a lateral elevation view of the frame, from direction B of FIG. 1, including the stationary plate that closes the bottom of the chambers.
Figure 4:
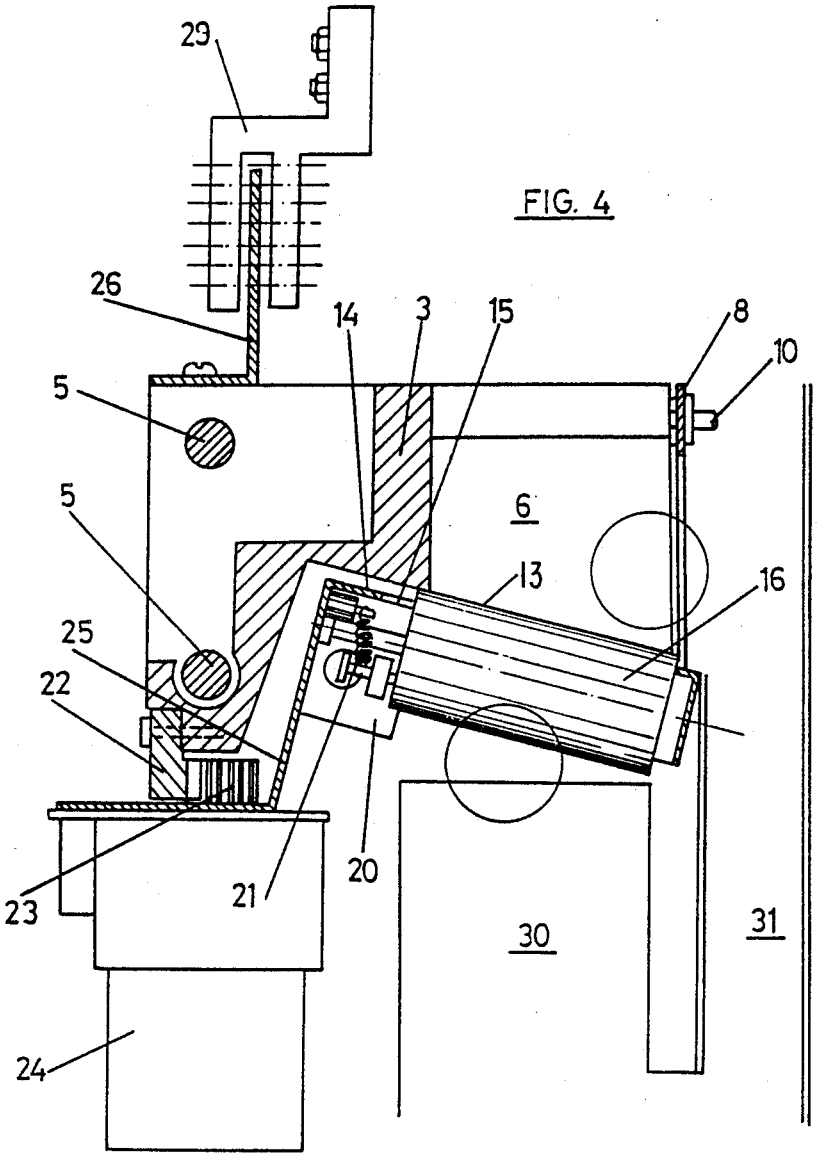
FIG. 4 is a section along line IV—IV of FIG. 2.
Figure 5:
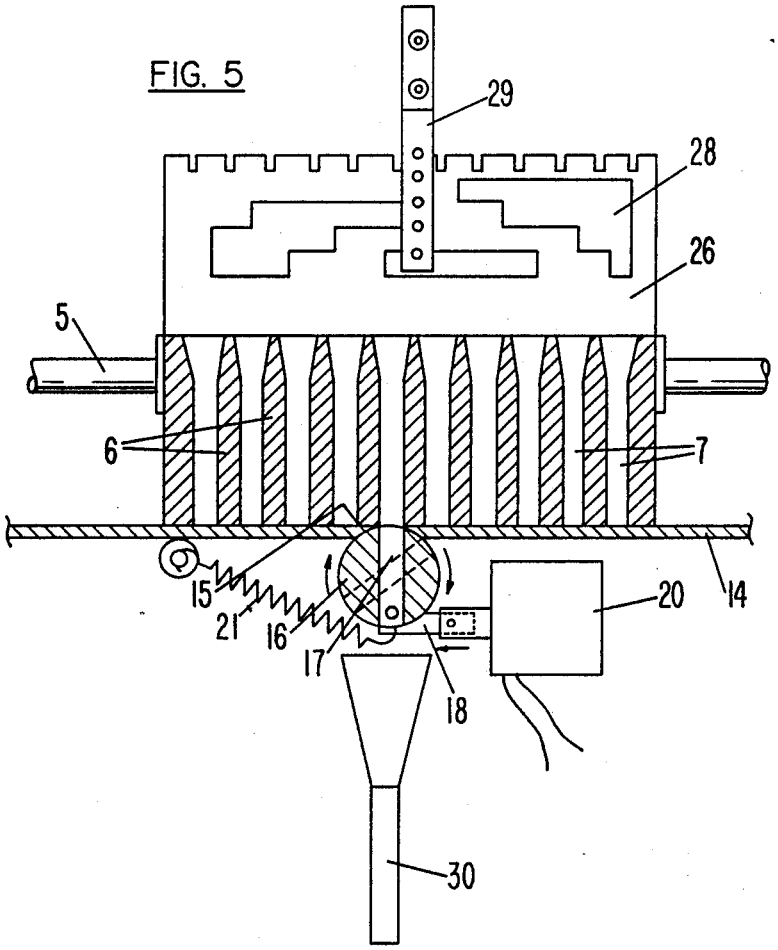
FIG. 5 is a section along line V—V of FIG. 2.
Figure 6:
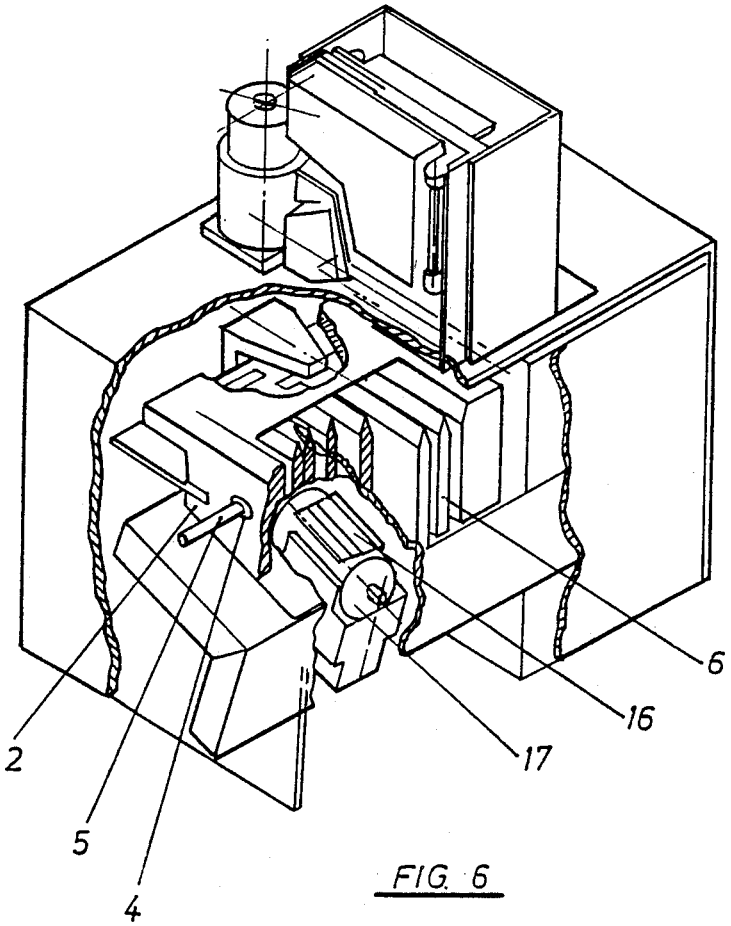
FIG. 6 is a perspective view of the entire mechanism.

As FIGS. 3 and 4 show, in the zone of chamber 7, walls 1 and 2 of the frame and the intermediate partitions 6 have a lower edge 13 which is slanted toward the open lateral wall of the chambers, in which movable plate 8 is located. Under the frame, positioned against the slanted lower edge 13 of the walls and partitions, is a plate 14 which is stationary with respect to the frame. This plate, as shown in FIGS. 4 and 5, has a transverse aperture 15, the dimensions of which are equal to or slightly larger than those of the open bottom of the chambers 7. Below plate 14 is a gate that can open and close aperture 15. In the example shown said gate consists of a cylinder 16 that is located alongside aperture 15 and is tangential or slightly secant to said aperture. Cylinder 16, as shown in FIG. 5, has a groove 17 passing through its diameter of approximately the same length and width as the chambers or passages 7. Cylinder 16 is connected by means of a rod 18 to the core of an electromagnet 20. By activating this electromagnet, cylinder 16 can be in the position shown in FIG. 5, in which the groove 17 is opposite the aperture 15 of plate 14, or in the position represented by dotted lines, where it is moved angularly, the lateral surface of cylinder 16 closing aperture 15. By means of the spring 21 cylinder 16 is impelled toward the closed position represented by dotted lines, which occurs when the electromagnet 20 is shut off.

The height and length of the chambers or passages 7 are greater than the diameter of the largest acceptable coin, the separation between walls or partitions 6 being slightly greater than the thickness of said coin.

On the side opposite the one where plate 8 is located the frame has a rack 22, which meshes with a pinion 23 and which is driven by means of an electric motor 24.

The pinion 23 and motor 24 can be mounted on an elbow extension 25 of stationary plate 14 that closes the bottom end of the vertical chambers or passages.

On the top of the frame there is also a plate 26 with grooves 27 and windows 28 of the correct shape, size and position to serve as a decoder which passes constantly between the arms of decoder 29, to provide information concerning the position of the frame at any given moment and concerning the coin in each of the chambers 7.

The frame described is located immediately under the exit of the coin selector of the machine. When the frame is moved by motor 24, each of the different chambers 7 is positioned successively under the exit of the selector. As soon as a coin drops into a chamber 7, the microprocessor receives the corresponding information and activates the motor 24 to move the frame so that the next chamber is positioned under the exit of the selector.

After the user has inserted all the coins and has selected the desired product or service, the microprocessor instructs motor 24 to move the frame so that chambers 7 are successively positioned opposite aperture 15 of stationary plate 14. Each time one of these chambers is opposite aperture 15 electromagnet 20 is activated, so that cylinder 16 moves to the position shown in FIG. 5, whereupon the coin in the chamber opposite falls into channel 30 for collection of the coins. By means of the microprocessor the coins corresponding to the exact or closest value of the product or service selected by the user are collected. Once the necessary coins have been collected, the frame continues moving until plate 8 hits a stationary lateral stop, not shown, causing said plate to move with respect to the frame, the windows 11 being opposite the chambers 7, so that, due to the slant of the bottom of these chambers, the coins fall into channel 31 for their direct return.

Figure 1:
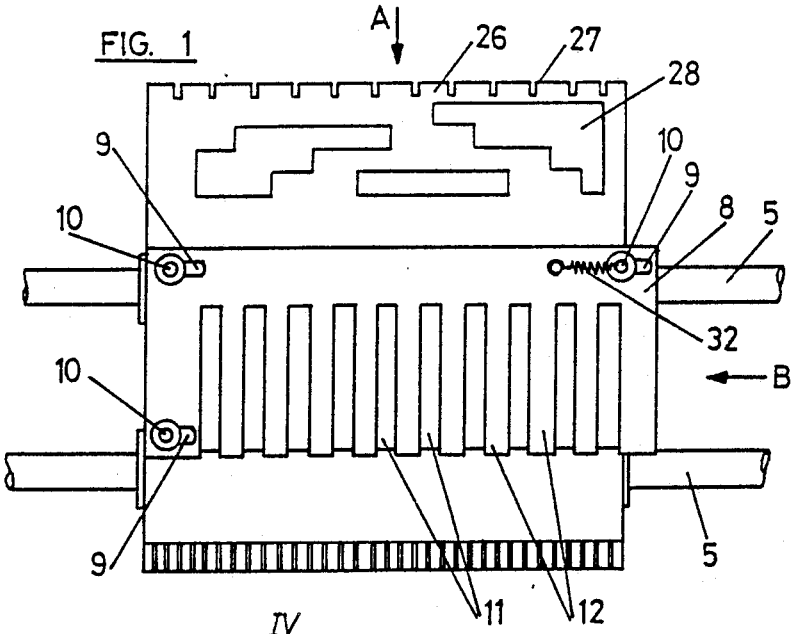
FIG. 1 is an elevation of the frame, viewed from the side on which the movable plate that closes the lateral opening of the chambers is located.
Figure 2:
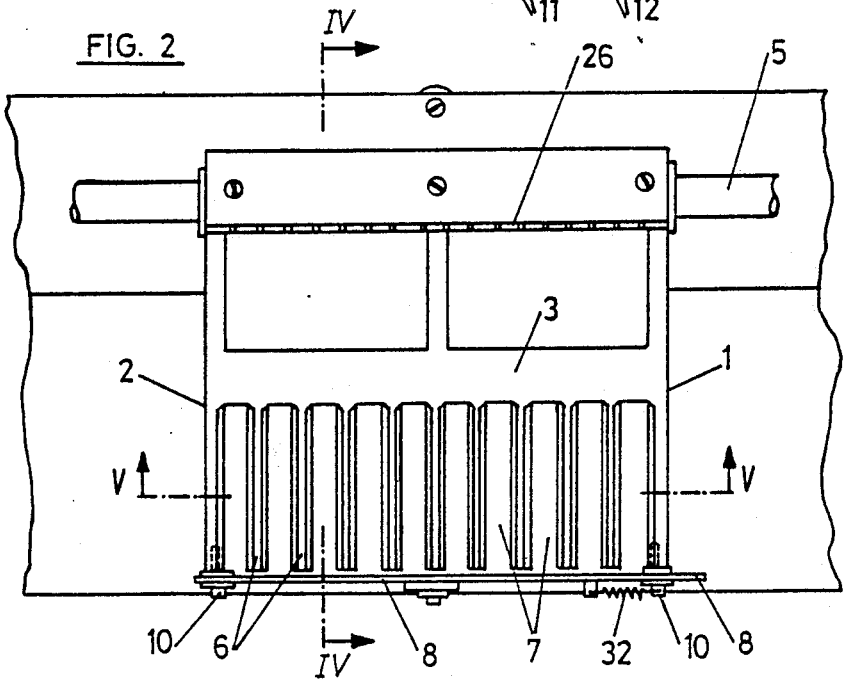
FIG. 2 is a plan view from direction A of FIG. 1.

As shown in FIG. 1, plate 8, which closes the compartments laterally, is impelled toward the closed position by a spring 32, so that the chambers open laterally when plate 8 hits the abovementioned stationary lateral stop, nullifying the force of said spring.

The gate that closes aperture 15 of plate 8 from the underside could be flat and capable of sliding, activated by an electromagnet.

The frame could also be mounted on guides or rails different from those described.

What is claimed is:

1. A mechanism for the reception and collection of coins in coin-operated machines, comprising a frame movable along guides, located immediately below an exit of a coin entry selector of a coin-operated machine; a series of identical vertical chambers including a top and bottom and lateral walls, formed consecutively in the frame by a series of vertical partitions, the chambers being open at said top and bottom, as well as at one of said lateral walls; means for opening and closing the bottom and said one lateral wall of the chambers; frame driving means for moving the frame in a direction perpendicular to the chambers so that the open top of said chambers is successively positioned under the exit of the selector; and means for driving said means for opening and closing the bottom and said one lateral wall of the chamber; said chambers being of a length and height greater than the diameter of a largest acceptable coin and of a width slightly larger than the thickness of the largest acceptable coin, a decoder on the frame; a reader stationary with respect to the decoder for reading the decoder to produce information concerning the position of the frame at any given moment; and said means for driving the frame and said means for driving said opening and closing means being controllable by a microprocessor, based on information provided concerning the chamber in which each coin is located and information from the reader concerning the position of the frame at any given moment.

2. A mechanism according to claim 1 wherein said frame includes a wall closing the side opposite to the open lateral walls; said opening and closing means including a bottom plate and a side plate, said side plate comprising vertical windows that can be positioned opposite said open lateral walls of the chambers, said bottom plate comprising an aperture that can be positioned opposite said open bottom of the chambers, for the release of the coins contained in said chambers; all of the partitions having a lower edge that is slanted longitudinally in a downward direction toward the open lateral walls.

3. A mechanism according to claim 2, wherein each of said vertical windows, starting at a lower edge, has a width equal to that of said chambers and has a height greater than the diameter of said largest acceptable coin; said windows being spaced at a distance equal to the width of the partitions separating said chambers; said side plate being mounted between horizontal guides on which it can be moved between two end positions, one a closed position, in which the windows are opposite the vertical partitions, and other an open position, in which said windows are opposite the vertical chambers, for permitting the release of coins in a return channel; and said opening and closing means including a spring for impelling the side plate toward the closed position.

4. A mechanism according to claim 2, wherein the bottom plate that closes the bottom of the chambers is stationary so that the frame moves relative thereto and is positioned against the slanted lower edge of the partitions for closing said chambers; said bottom plate has a transverse aperture, the dimensions of which are equal to those of the open bottom of the chambers; the opening and closing means includes a gate for opening and closing the aperture in said bottom plate; said bottom plate aperture being successively positioned, when the frame moves, opposite different chambers so that the coins fall into a collection channel when the gate opens.

5. A mechanism according to claim 4, wherein the opening and closing means driving means includes an electromagnet controllable by the microprocessor for operating the gate.

6. A mechanism according to claim 4, wherein said gate includes a cylinder which has an axis parallel to said aperture of the bottom plate, which is placed lengthwise in a tangential position beneath said aperture and which has a groove passing through its diameter, said groove having dimensions which are approximately equal to those of the open bottoms of the chambers; said cylinder being mounted so as to make a partial turn around an axis, between two positions, one an open position, in which the groove is opposite the aperture of the plate, and the other a closed position, in which said groove is moved angularly so that a lateral surface of the cylinder closes said aperture; said opening and closing means driving means includes an electromagnet with a rod connected eccentrically to a base of the cylinder for rotating the cylinder to one of the opened or closed positions, and a spring for returning the cylinder to the other position.

7. A mechanism according to claim 1, where the frame driving means includes a rack, which is part of said frame, a pinion that meshes with said rack, and an electric motor controllable by the microprocessor for driving the pinion.

8. A mechanism according to claim 2, wherein the bottom plate that closes the bottom of the chambers is stationary so that the frame moves relative thereto and is positioned against the slanted lower edge of the partitions for closing said chambers; said bottom plate has a transverse aperture, the dimensions of which are slightly larger than those of the open bottom of the chambers; the opening and closing means includes a gate for opening and closing the aperture in said bottom plate; said bottom plate aperture being successively positioned, when the frame moves, opposite different chambers so that the coins fall into a collection channel when the gate opens.

9. A mechanism according to claim 4, wherein said gate includes a cylinder which has an axis parallel to said aperture of the bottom plate, which is placed lengthwise in a slightly secant position beneath said aperture and which has a groove passing through its diameter, said groove having dimensions which are approximately equal to those of the open bottoms of the chambers; said cylinder being mounted so as to make a partial turn around an axis, between two positions, one an open position, in which the groove is opposite the aperture of the plate, and the other a closed position, in which said groove is moved angularly so that a lateral surface of the cylinder closes said aperture; said opening and closing means driving means includes an electromagnet with a rod connected eccentrically to a base of the cylinder for rotating the cylinder to one of the opened or closed positions, and a spring for returning the cylinder to the other position.

10. A mechanism according to claim 8, wherein said gate includes a cylinder which has an axis parallel to said aperture of the bottom plate, which is placed lengthwise in a slightly secant position beneath said aperture and which has a groove passing through its diameter, said groove having dimensions which are approximately equal to those of the open bottoms of the chambers; said cylinder being mounted so as to make a partial turn around an axis, between two positions, one an open position, in which the groove is opposite the aperture of the plate, and the other a closed position, in which said groove is moved angularly so that a lateral surface of the cylinder closes said aperture; said opening and closing means driving means includes an electromagnet with a rod connected eccentrically to a base of the cylinder for rotating the cylinder to one of the opened or closed positions, and a spring for returning the cylinder to the other position.

* * * * *